US006258315B1

(12) United States Patent
Araki et al.

(10) Patent No.: US 6,258,315 B1
(45) Date of Patent: Jul. 10, 2001

(54) FURNACE BODY STRUCTURAL MEMBER FOR METALLURGICAL SHAFT FURNACE

(75) Inventors: Tsuneo Araki; Kenichi Fukagawa; Atsushi Sakai, all of Fukuyama; Takashi Sumigama, Yokohama, all of (JP)

(73) Assignees: NKK Corporation, Tokyo; Nippon Chuzo Kabushiki Kaisha, Kawasaki, both of (JP)

( * ) Notice: Subject to any disclaimer, the term of this patent is extended or adjusted under 35 U.S.C. 154(b) by 0 days.

(21) Appl. No.: 09/217,562

(22) Filed: Dec. 21, 1998

(30) Foreign Application Priority Data

Dec. 26, 1997 (JP) ..... 9-368428

(51) Int. Cl.[7] ..... C21B 7/10
(52) U.S. Cl. ..... 266/193; 266/190
(58) Field of Search ..... 266/193, 194, 266/190

(56) References Cited

U.S. PATENT DOCUMENTS

| | | | |
|---|---|---|---|
| 4,162,061 | 7/1979 | Bühler et al. . | |
| 4,768,447 | 9/1988 | Roumeguere . | |
| 4,892,293 * | 1/1990 | Kato et al. | 266/193 |

FOREIGN PATENT DOCUMENTS

| | | |
|---|---|---|
| 53 701/79 | 6/1980 | (AU) . |
| 27 19 165 | 7/1978 | (DE) . |
| 29 49 998 | 6/1980 | (DE) . |
| 0 228 918 | 7/1987 | (EP) . |
| 7-90334 | 4/1995 | (JP) . |

OTHER PUBLICATIONS

Patent Abstracts of Japan, vol. 095, No. 007 (Aug. 31, 1995), Abstract of JP 07 090334 A (Apr. 4, 1995).
Database WPI, Section Ch, Week 8325, Derwent Publications Ltd., AN 83–60927K of SU 949 003 B (Aug. 10, 1982).
Database WPI, Section Ch, Week 8536, Derwent Publications Ltd., AN 85–219627 of JP 60 140089 A (Jul. 24, 1985).
Patent Abstracts of Japan, vol. 018, No. 485 (C–1248) (Sep. 9, 1994), Abstract of JP 06 158130 A (Jun. 7, 1994).
Patent Abstracts of Japan, vol. 097, No. 009 (Sep. 30, 1997), Abstract of JP 09 137210 A (May 27, 1997).
A. Nash, "Stave utilization in North American blast furnaces", *Iron and Steel Engineering,* vol. 69, No. 12, pp. 26–29 (Dec. 1, 1992).

* cited by examiner

*Primary Examiner*—Scott Kastler
(74) *Attorney, Agent, or Firm*—Frishauf, Holtz, Goodman, Langer & Chick, P.C.

(57) ABSTRACT

A structural member of a furnace body for a shaft furnace includes a metallic structural member (1) having a flow path for a coolant therein; inner furnace refractories (2) provided on a cooling surface of the metallic structural member; metallic supporting members (3) for connecting which support the inner furnace refractories on the metallic structural member; and heat insulating members (4) arranged between the metallic supporting members and the inner furnace refractories.

13 Claims, 9 Drawing Sheets

FURNACE BODY STRUCTURAL MEMBER FOR METALLURGICAL SHAFT FURNACE

BACKGROUND OF THE INVENTION

1. Field of the Invention

The present invention relates to a structural member of a furnace body having a cooling mechanism which is used for constructing a furnace wall or a bottom of a furnace of a metallurgical shaft furnace.

2. Description of the Related Arts

With respect to a metallurgical shaft furnace such as a blast furnace, it is necessary to cool the refractories of the furnace wall and the bottom of the furnace to reduce erosion from the inside of the furnace, and to prolong the service life of the furnace body. Heretofore, a variety of apparatuses have been proposed in order to cool a furnace body of a blast furnace and the like, and have been put into practical use. A stave cooler has superior properties in uniformly cooling the refractories in the furnace, so that this is universally used for blast furnaces. In general, the stave cooler has a configuration in which refractories (refractory bricks) are fixed on an inner side of a furnace of a cast metal portion, in which are cast cooling tubes.

With respect to the stave cooler, it is important that refractories (refractory bricks) be uniformly cooled and also not fall off from the cast metal portion. In order to obtain the above-mentioned properties, a cooling apparatus for a furnace body is disclosed in Japanese Unexamined Patent Publication No. 7-90334, in which a cast metal portion in which are cast cooling tubes and inner furnace refractories arranged so as to be intercalated by a heat insulating buffer member, and the inner furnace refractories are supported by inserting a supporting member for connecting into a hole for mounting provided at the inner furnace refractories, the supporting member for connecting being made of refractories protrudingly provided at a cast metal portion. In this disclosure, the supporting member for connecting the inner furnace refractories is constructed by refractories having high thermal conductivity and strength at a high temperature whose main component is molybdenum or molybdenum/zirconia or the like. Heat exchange is performed between the cooling tubes at the cast metal portion and the inner furnace refractories through the supporting member for connecting, so that the inner furnace refractories are satisfactorily cooled.

It is, however, clear that a conventional structural member of a furnace body has a problem in which inner furnace refractories easily fall off, although an object of the conventional art is proper cooling and preventing the inner furnace refractories from falling off.

SUMMARY OF THE INVENTION

It is an object of the present invention to provide a structural member of a furnace body which properly cools inner furnace refractories and also effectively prevents them from falling off.

The Inventors have studied the causes of falling off of inner furnace refractories and countermeasures therefor with respect to the above-described conventional cooling apparatus for a furnace body (a structural member of a furnace body). As a result, in the conventional cooling. apparatus for the furnace body, a supporting member for connecting is particularly constructed for refractories having high thermal conductivity and being made of molybdenum or the like as a main component, and the inner furnace refractories are cooled from the inside due to cooling properties based on high thermal conductivity of the supporting member for connecting. However, it is clear that this supporting construction of the inner furnace refractories itself is a main factor causing the inner furnace refractories to fall off.

Basic problems in the conventional construction are as follows. The supporting member for connecting made of refractories in which a main component is molybdenum or the like has low bending strength, resulting in easy breakage due to an impact load or the like. Furthermore, thermal inhomogeneities occur within the refractories due to cooling of the inside of the refractories with the supporting member for connecting so as to readily cause damage such as cracking of the refractories. It is clear that the breakage of the supporting member for connecting and the damage to the inner furnace refractories due to cooling by the supporting member for connecting are main causes of falling off of the inner furnace refractories.

Therefore, it is clear that the inner furnace refractories can be effectively prevented from falling off, because a material of the supporting member for connecting, which cannot breakdown is employed, and at the inside of the inner furnace refractories, it is possible to maximally avoid cooling by the supporting member for connecting in contrast to the conventional art, so as to prevent the inside of the refractories from producing thermal inhomogeneities. On the other hand, it is also clear that the inner furnace refractories are properly cooled only by a rear surface which is brought into contact with a stave side, although the inside of the inner furnace refractories are cooled by the supporting member for connecting.

The present invention is performed based on the above-described knowledge, and the features are described below.

[1] A structural member of a furnace body for a metallurgical shaft furnace, including: a metallic structural member having a flow path for a coolant therein; inner furnace refractories provided on a cooling surface of the metallic structural member; metallic supporting members for connecting which support the inner furnace refractories on the metallic structural member by being protrudingly provided on the cooling surface of the metallic structural member and by being inserted into grooves for mounting or holes for mounting formed on a rear surface side of the inner furnace refractories; and heat insulating members being inserted between the supporting members for connecting and inner surfaces of the grooves for mounting or the holes for mounting.

[2] A structural member of a furnace body for a metallurgical shaft furnace described in the paragraph [1], wherein the metallic structural member comprises a cooling tube which forms the flow path for the coolant and a cast metal portion which is cast around the cooling tube.

[3] A structural member of a furnace body for a metallurgical shaft furnace described in the paragraph [1] or [2] further comprising a heat insulating buffer member arranged between the cooling surface of the metallic structural member and the rear surface of the inner furnace refractories.

[4] A structural member of a furnace body for a metallurgical shaft furnace described in any of the paragraphs [1] to [3] further comprising, a plurality of refractory bricks as the inner furnace refractories; and grooves for mounting formed at both side portions of a rear surface side of each refractory brick for inserting the supporting members for connecting.

[5] A structural member of a furnace body for a metallurgical shaft furnace described in the paragraph [4], wherein a length a of the groove for mounting in the width direction of the refractory brick and a distance L between the groove for mounting and an upper end surface of the refractory brick satisfy the relationships L>a.

[6] A structural member of a furnace body for a metallurgical shaft furnace described in any of the paragraphs [1] to [5], wherein the supporting member for connecting includes a metallic cylindrical bar.

[7] A structural member of a furnace body for a metallurgical shaft furnace described in any of the paragraphs [1] to [6] further comprising, a plurality of rear bricks provided protrudingly on the rear surface of the inner furnace refractories, and the cooling surface of the metallic structural member being formed along the rear surface of the inner furnace refractories including an outer surface of the rear brick.

[8] A structural member of a furnace body for a metallurgical shaft furnace described in any of the paragraphs [4] to [7] further comprising, heat insulating members arranged between the adjacent refractory bricks.

DESCRIPTION OF THE PREFERRED EMBODIMENT

Figure 1:
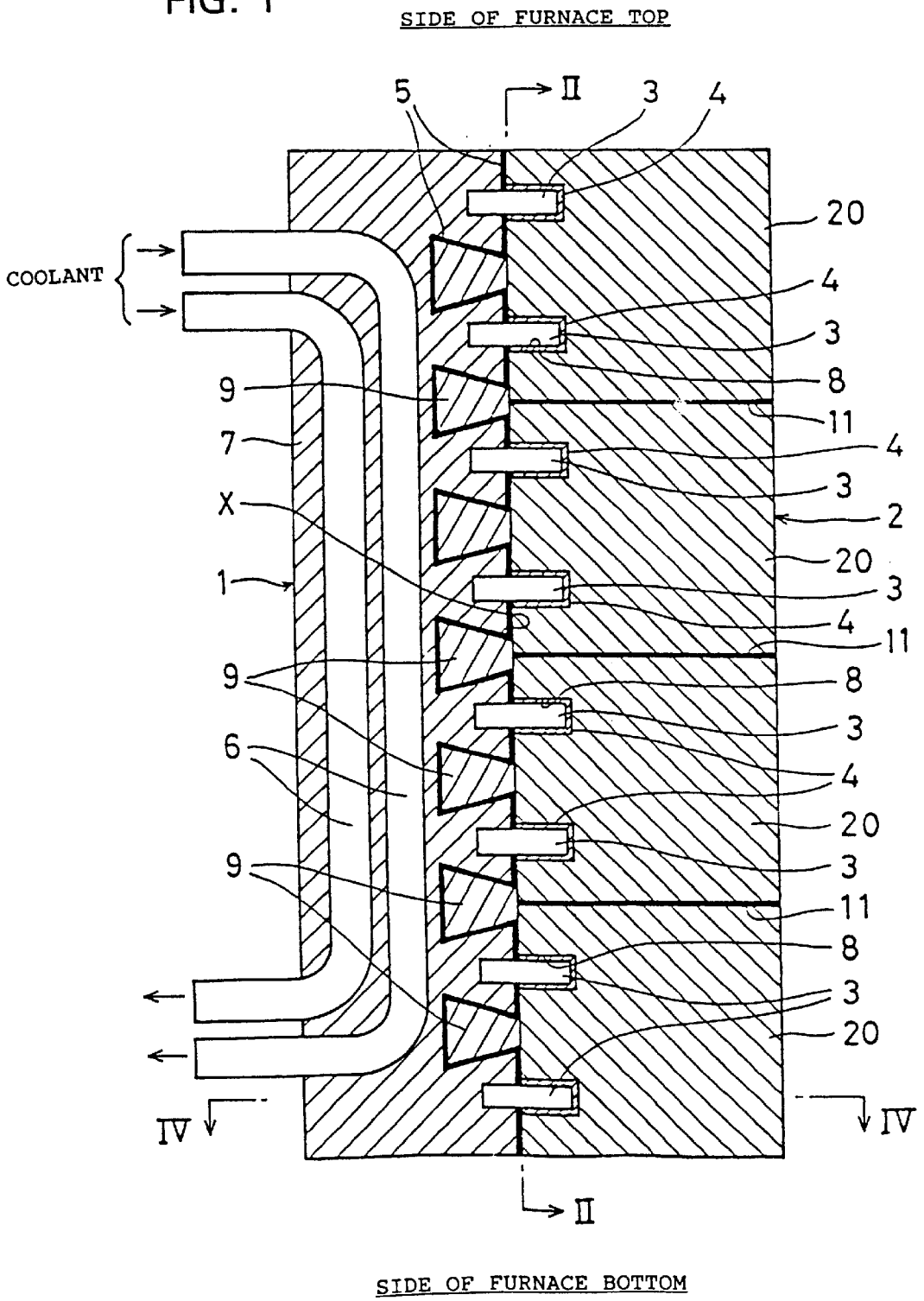
FIG. 1 is a longitudinal sectional view of structural members of a furnace body according to an embodiment of the present invention.
Figure 2:
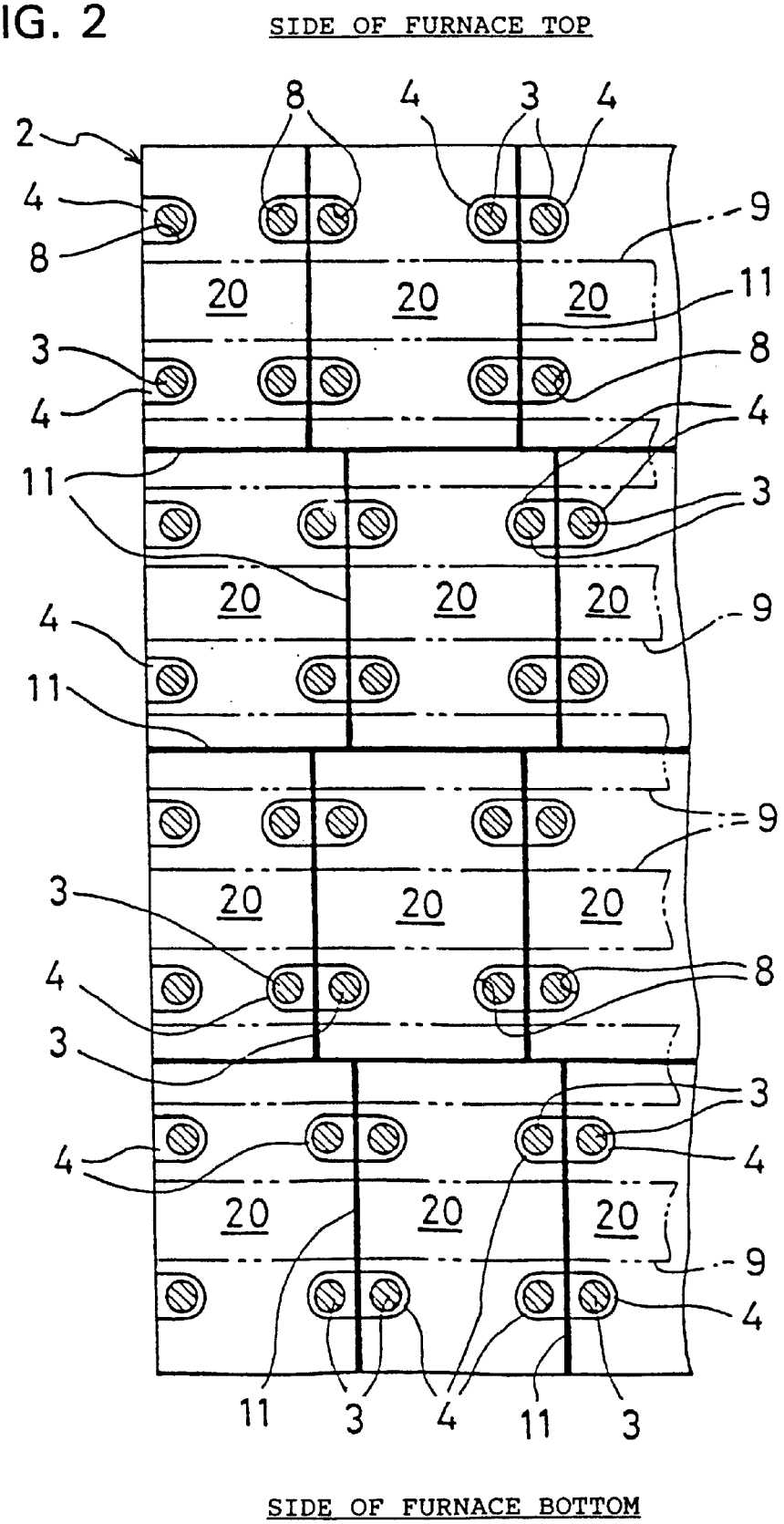
FIG. 2 is a cross-sectional view taken along line II—II of FIG. 1.
Figure 3:
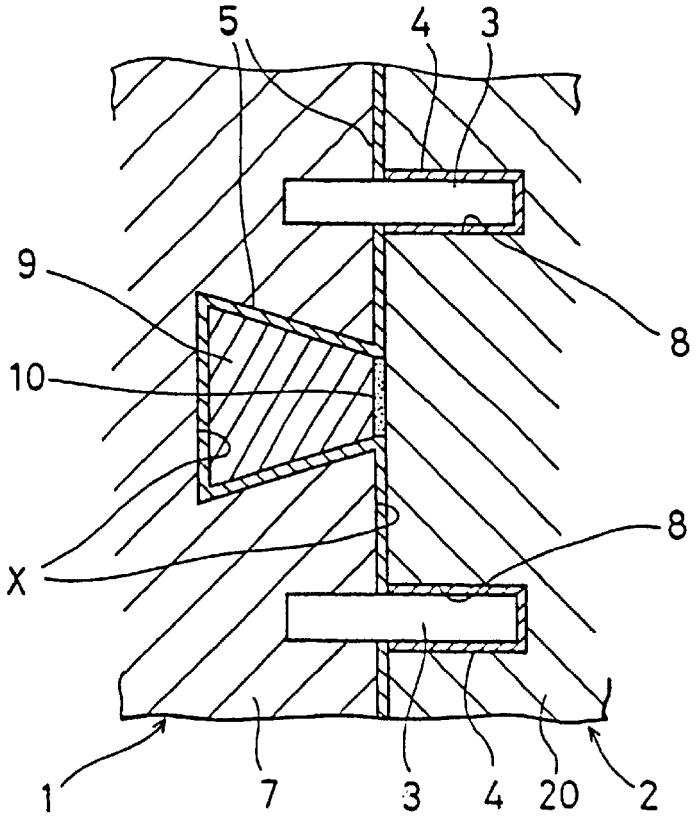
FIG. 3 is an enlarged fragmentary longitudinal sectional view of a supporting member for connecting and a rear brick.
Figure 4:
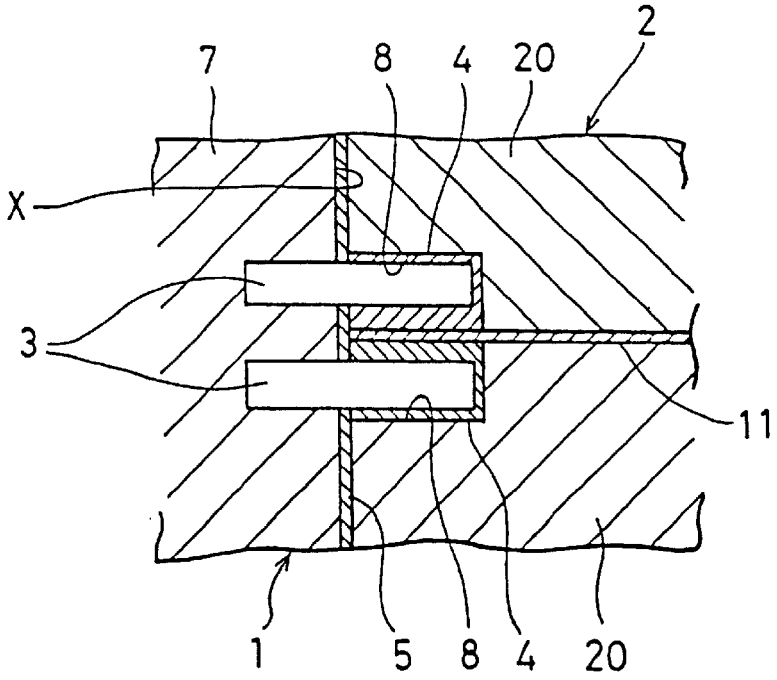
FIG. 4 is a cross-sectional view taken along line IV—IV of FIG. 1.
Figure 5:
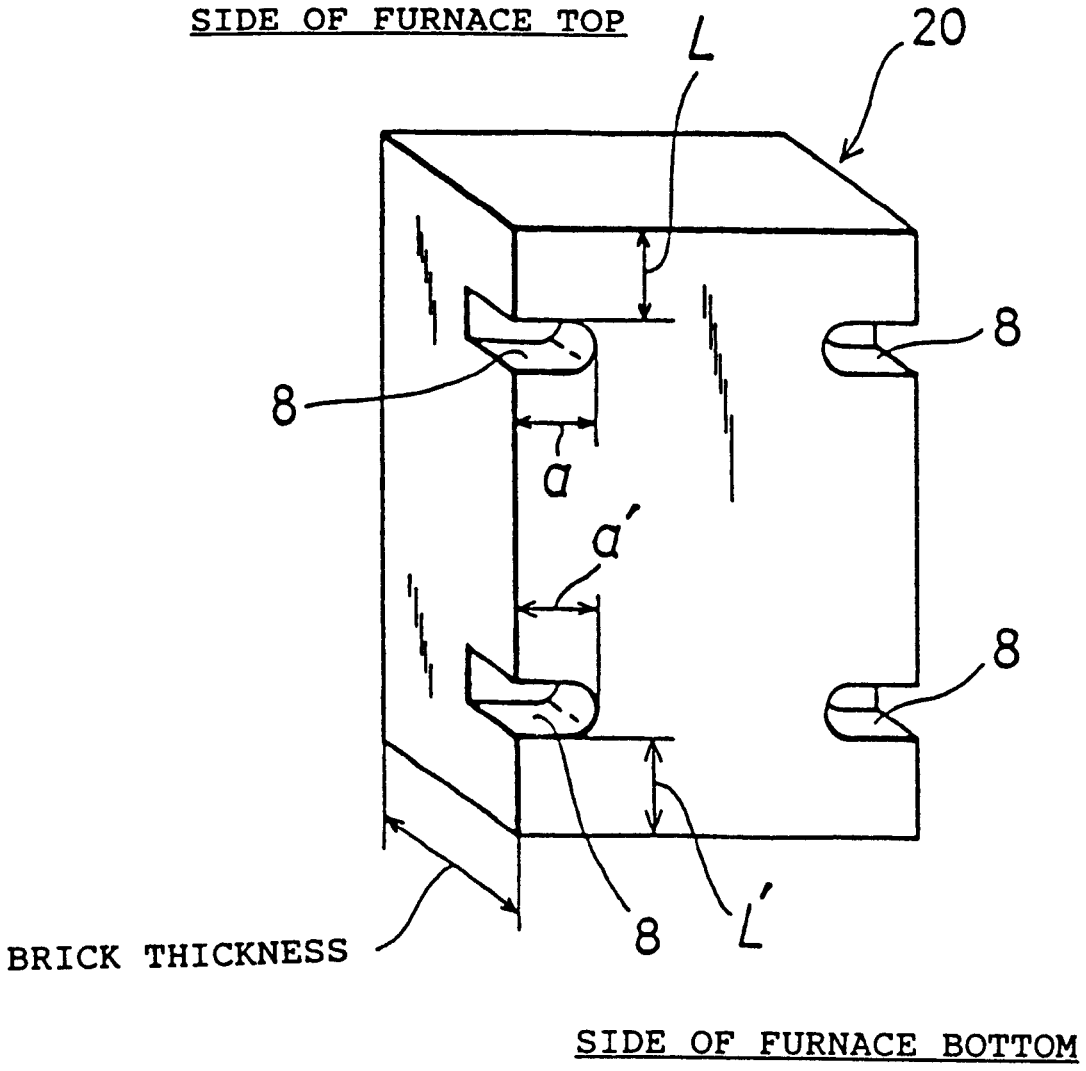
FIG. 5 is an isometric view of a refractory brick which make up inner furnace refractories as shown in FIG. 1.

FIGS. 1 to 5 show structural members of a furnace body according to an embodiment in accordance with the present invention. FIG. 1 is a longitudinal sectional view thereof. FIG. 2 is a cross-sectional view taken along line II—II of FIG. 1. FIG. 3 is an enlarged fragmentary longitudinal sectional view of a supporting member for connecting and a rear brick. FIG. 4 is a cross-sectional view taken along line IV—IV of FIG. 1. FIG. 5 is an isometric view of a refractory brick which makes up inner furnace refractories.

In the drawings, reference numeral 1 denotes a metallic structural member having flow paths for a coolant within itself. Reference numeral 2 denotes inner furnace refractories (front bricks) provided on a cooling surface x of the metallic structural member 1. Reference numeral 3 denotes a supporting member for connecting which is protrudingly provided at a plurality of areas on the cooling surface x of the metallic structural member 1, and which supports an inner furnace refractories 2 by being inserted into a groove 8 which is provided on a rear surface side of the inner furnace refractories. Reference numeral 4 denotes a heat insulating member which is inserted between the supporting member for connecting 3 and the inner surface of the groove 8. Reference numeral 5 denotes a heat insulating buffer member which is inserted between the cooling surface x of the metallic structural member and the rear surface of the inner furnace refractories 2.

The metallic structural member 1 comprises cooling tubes 6 which are flow paths for a coolant, and a cast metal portion 7 which is cast around the cooling tubes 6. Usually, the cooling tubes 6 are made of hollow steel tubes, and the cast metal portion 7 is made of cast iron.

The inner furnace refractories 2 are provided on the cooling surface x of the metallic structural member 1 by being intercalated with the heat insulating buffer member 5. The inner furnace refractories 2 are made of a plurality of refractory bricks 20 which are arranged vertically and horizontally on the cooling surface x of the metallic structural member 1. A compressible heat insulating member 11 is inserted between the adjacent refractory bricks 20 to absorb thermal expansion. The heat insulating member 11 is made of glass-wool, rock wool, or the like.

Each refractory brick 20 has a plurality of grooves 8 on the rear surface side thereof for inserting the supporting members for connecting 3 which are protrudingly provided on the cooling surface x of the metallic structural member 1. The refractory brick 20 according to this embodiment has two grooves 8 at an upper and a lower region of both side portions on the rear surface side thereof, as shown in FIGS. 2 and 5. The depth of this groove 8 is not equal to the entire thickness of the refractory brick 20, and the groove 8 is formed so as to have a proper depth being provided from the rear surface side (the depth is about 10 to 50% of the entire thickness of the brick).

As shown in FIG. 5, the groove 8 is preferably formed in such a manner that a length a of the groove 8 in the width direction of the refractory brick and a distance L between the groove 8 and the upper end surface of the refractory brick satisfy the relationship L>a (when two grooves 8 are provided at an upper and a lower region of the rear surface side of the refractory brick according to the present embodiment, the upper groove 8 preferably satisfies the above-mentioned relationship). When L and a satisfy the relationship L≦a, a part of the brick at an upper portion of the groove is easily damaged due to tensile stress caused by an external force which is caused by friction between the self-weight of the brick and the loaded member in the furnace, so that the relationship is not preferable. Furthermore, based on the same reason, the lower groove 8 is preferably formed in such a manner that a length a' of the groove 8 in the width direction of the refractory brick and a distance L' between the groove 8 and the lower surface of the refractory brick satisfy the relationship L'>a'.

In addition, the refractory brick 20 is preferably made of an SiC based refractory brick (for example, SiC:70 to 100 wt %, $SiO_2$: 0 to 30 wt %) or the like from the stand point of durability.

Furthermore, in accordance with the present embodiment, a rear brick 9 is protrudingly provided between the adjacent supporting members for connecting 3 at a rear surface of the inner furnace refractories 2 and is fixed to the inner furnace refractories using mortar 10 as shown in FIG. 3, in order to prevent a steep thermal gradient from occurring in the inner furnace refractories 2 (front brick) and to obtain a certain insulating effect even if the inner furnace refractories 2 fall off. A cross-sectional view of this rear brick 9 is an approximate trapezium and the raised bottom thereof is fixed to the rear surface of the inner furnace refractories.

Therefore, a cooling surface x of the metallic structural member 1 is formed along the concave-convex rear surface the inner furnace refractories 2 including an outer surface of the rear brick 9.

The heat insulating buffer member 5 is provided for absorbing thermal shock to the refractory brick 20 at casting of the cast metal portion 7, and is inserted between the rear surface the inner furnace refractories 2 including the outer surface of the rear brick 9 and the cooling surface x of the metallic structural member 1. This heat insulating buffer member 5 is made of glass wool, rock wool, or the like.

The supporting member for connecting 3 is protrudingly provided on the cooling surface x of the metallic structural member 1 by fixing one end of a cylindrical bar to the cast metal portion 7 which is used to construct the metallic structural member 1 (the fixation is performed by casting one end of the cylindrical bar into the cast metal portion 7 when the cast metal portion 7 is cast), and inserted into the groove 8 in the inner furnace refractories 2 so as to support the inner furnace refractories 2 to the metallic structural member 1. Usually, a length of the supporting member for connecting 3 (a protruding length from the cooling surface x) is determined at 10 to 50% the thickness of the refractory brick 20.

Since this supporting member for connecting 3 is constructed of a cylindrical bar according to the present embodiment, the strength of the supporting member for connecting itself is most easily ensured. And then, this construction is most preferable with respect to the strength of the refractory brick because of the possibility of making the size of the groove 8 small. However, the construction is not limited thereto, and the supporting member for connecting 3 may be constructed of a plate as described below in another embodiment. The supporting member for connecting 3 is preferably made of a metal having high heat resistance and high strength at a high temperature. Although a material thereof is not particularly limited, in particular, the material preferably includes a stainless steel such as SUS-310S, a heat resistant steel such as SS-400 and HA-230, or the like.

The supporting member for connecting 3 preferably has enough tensile strength and enough bending strength for supporting the refractories at a high temperature of 300 to 400° C.

The heat insulating member 4 is inserted between the supporting member for connecting 3 and the inner surface of the groove 8 for maximally suppressing thermal conductivity between thereof. Rock wool, glass wool, or the like can be used as the heat insulating member 4. Usually, the heat insulating member 4 is filled or inserted between the supporting member for connecting 3 and the groove 8 by being wound around or by being attached with a laminated form to the outer side of the supporting member for connecting 3, by being inserted into the groove 8 with the supporting member for connecting 3 with this state, and by being filled with a heat insulating material into a gap within the groove as the need arises. In addition, the heat insulating member 4 has a function for ensuring a clearance (usually 1 to 5 mm at room temperature) between the supporting member for connecting 3 and the groove 8 to absorb thermal expansion of the metallic supporting member for connecting 3.

Figure 6:
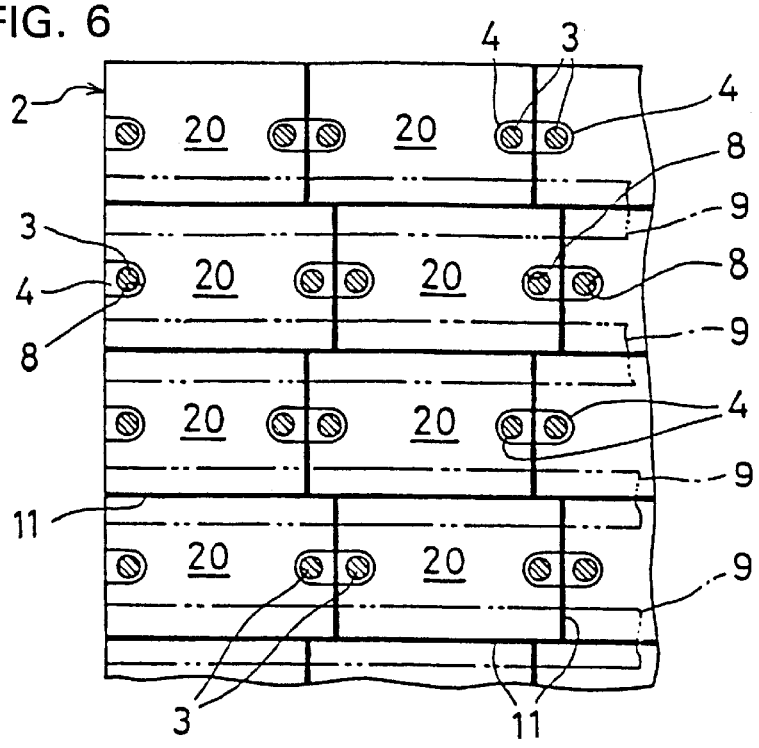
FIG. 6 is a schematic representation shown in a cross-sectional view of a supporting configuration of inner furnace refractories connected by supporting members for connecting according to another embodiment of the present invention in the same way as in FIG. 2.
Figure 7:
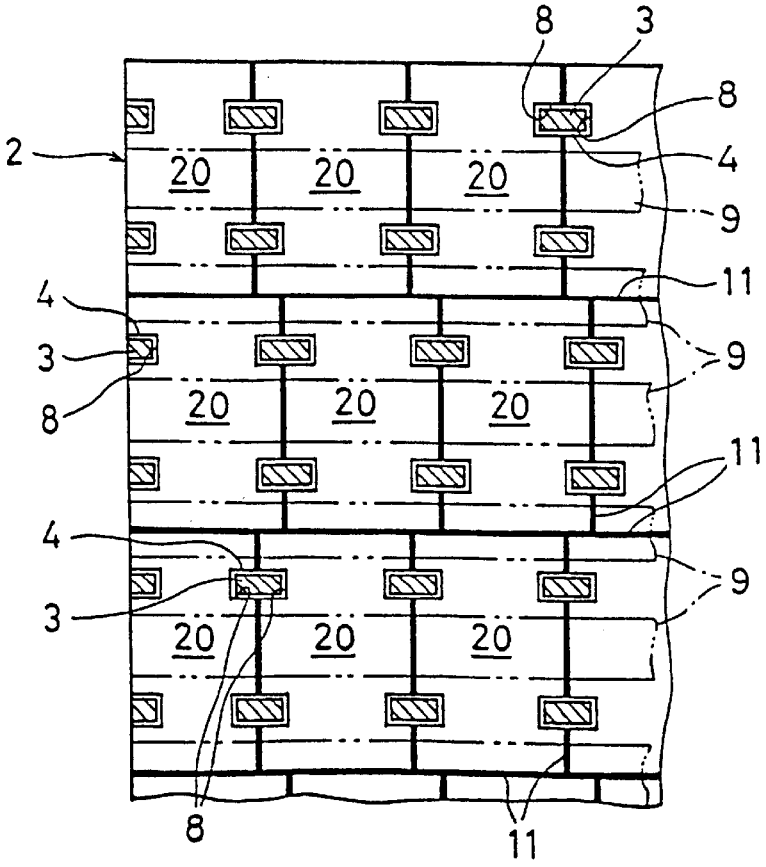
FIG. 7 is a schematic representation shown in a cross-sectional view of a supporting configuration of inner furnace refractories connected by supporting members for connecting according to yet another embodiment of the present invention in the same way as in FIG. 2.

FIGS. 6 and 7 are cross-sectional views of other embodiments of a supported construction of inner furnace refractories 2 by a supporting member for connecting 3 in the same way as FIG. 2. In the configuration as shown in FIG. 6, a height of each refractory brick 20 which makes up the inner furnace refractories 2 is made to be small, a groove 8 is provided at each one area of both side portions of the rear surface side of the refractory brick 20, and the supporting member for connecting 3 is inserted into the groove 8.

In the configuration as shown in FIG. 7, a groove 8 is provided at a similar position as that in FIG. 2, and a supporting member for connecting 3 is constructed of a plate member, so that both end portions of the supporting member for connecting 3 having a plate shape are inserted into both grooves 8 of the adjacent refractory bricks 20 in the width direction of a structural member of a furnace body.

A supporting member for connecting 3 and a supported configuration of inner furnace refractories 2 thereby may have a variety of configurations other than the above-described embodiments. For example, although in the above-described embodiments the groove for mounting 8 is provided on the rear surface side of the refractory brick 20 for supporting the inner furnace refractories 2 by the supporting member for connecting 3, a hole for mounting may be provided instead of the groove 8.

Figure 8:
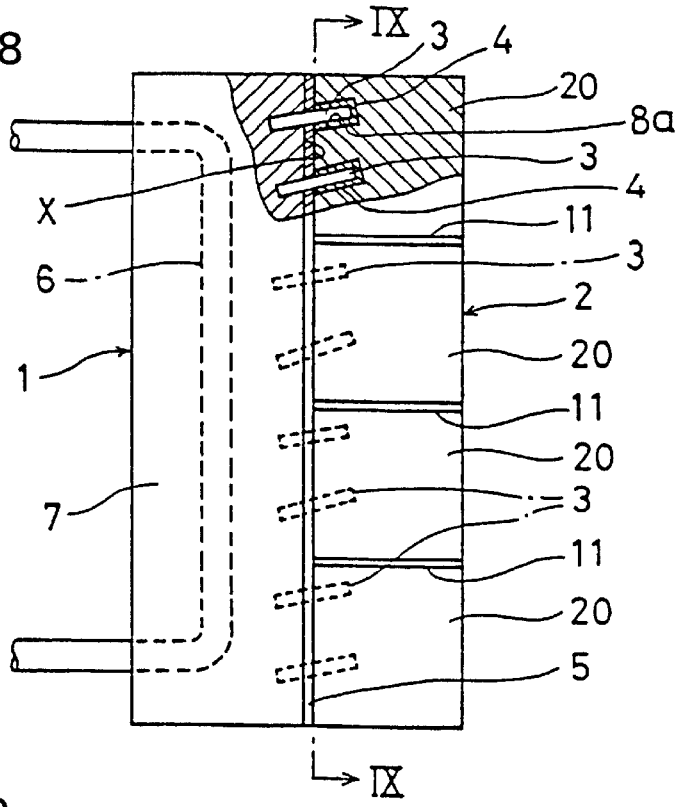
FIG. 8 is a partially cut off side view of a structural members of a furnace body according to yet another embodiment of the present invention.
Figure 9:
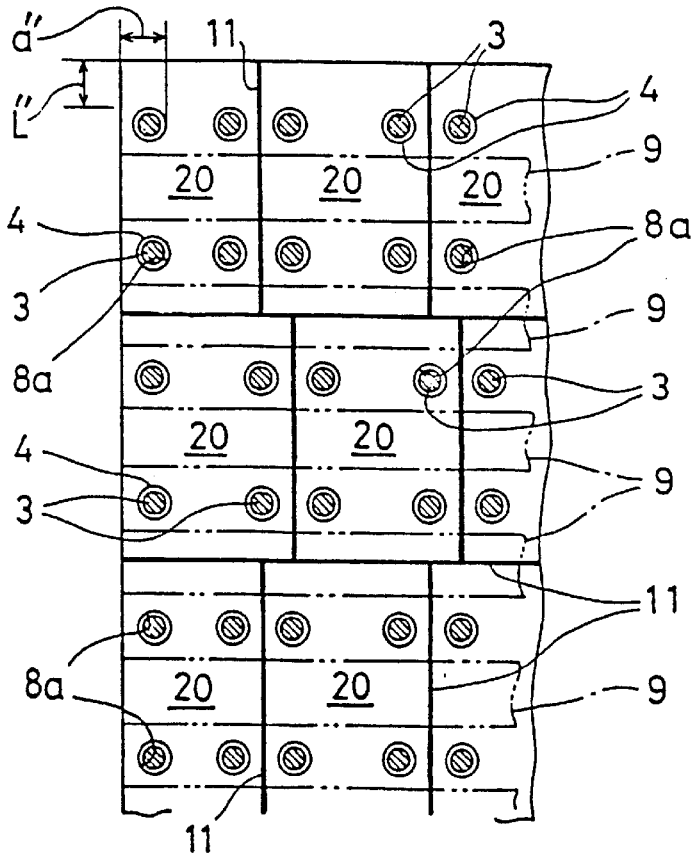
FIG. 9 is a cross-sectional view taken along line IX—IX of FIG. 8.
Figure 10:
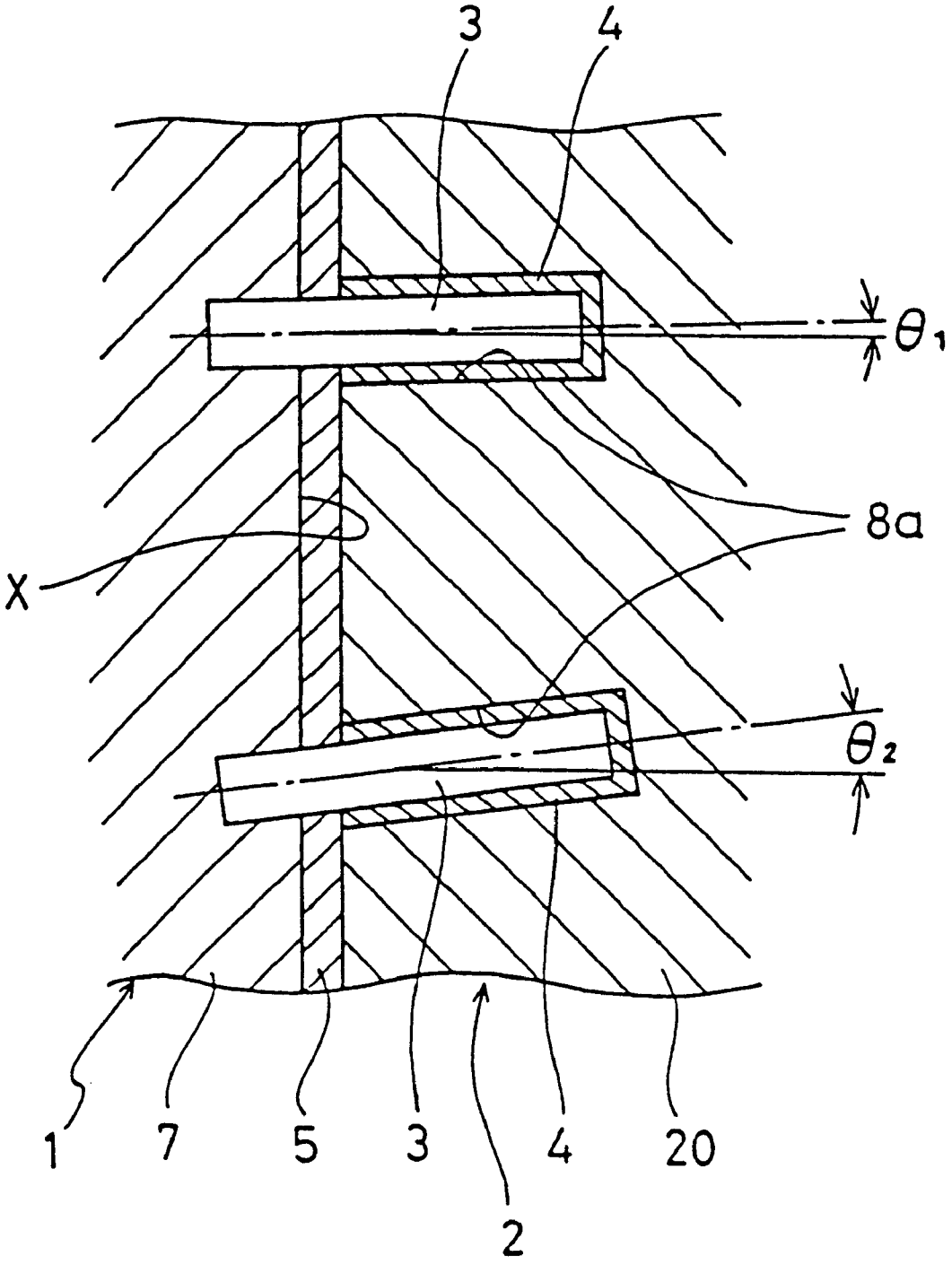
FIG. 10 is an enlarged fragmentary longitudinal sectional view of a mounting portion of a supporting member for connecting.

FIGS. 8 to 10 show an embodiment in which a hole for mounting 8*a* is formed on a rear surface of a refractory brick 20 for inserting a supporting member for connecting 3. FIG. 8 is a partially cut off side view, FIG. 9 is a cross-sectional view taken along line IX—IX of FIG. 8, and FIG. 10 is an enlarged fragmentary longitudinal sectional view of a supporting member for connecting 3.

According to this embodiment, each refractory brick 20 which makes up inner furnace refractories 2 has a plurality of holes for mounting 8*a* for inserting of the supporting member for connecting 3 on the rear surface side of the refractory brick. These holes for mounting 8*a* are formed at four areas, that is, upper, lower, right and left areas of each refractory brick 20, as shown in FIG. 9. In this embodiment, the holes for mounting 8*a* are preferably formed in such a manner that a distance a" between the inner end surface of the hole for mounting 8*a* within the refractory brick and the side end surface of the refractory brick and a distance L" between the upper end surface of the holes for mounting 8*a* and the upper end surface of the refractory brick satisfy the relationship L">a" (when the holes for mounting 8*a* are provided at an upper and a lower region of the rear surface side of the refractory brick, the upper hole for mounting 8*a* is preferably formed so as to satisfy the above-described relationship). The relationship L"≦a" is not preferable, because a part of the refractory brick is easily broken due to tensile stress caused by an external force which is caused by friction between the self-weight of the brick and the loaded member within the furnace.

The supporting member for connecting 3 which is protrudingly provided on a cooling surface x of a metallic structural member 1 is made of a metallic cylindrical bar. The inner furnace refractories 2 are supported to the metallic structural member 1 by inserting the supporting member for connecting 3 into the hole for mounting 8*a* through the heat insulating member 4.

According to the present embodiment, the supporting member for connecting 3 is upwardly inclined having an inclination angle $\theta_1$ or $\theta_2$ for preventing the refractory brick 20 from falling off from the supporting member for connecting 3, as shown in FIG. 10, and the inclination angles $\theta_1$ and $\theta_2$ of above and below supporting members for connecting 3 are different from each other. Since adjacent supporting members for connecting 3 above and below have a different inclination angle $\theta_1$ or $\theta_2$, the refractory brick 20 hardly falls off from the supporting member for connecting 3. Usually, the inclination angle is optionally selected from a range of 5 to 25°.

A rear brick 9 can be also provided on a rear surface side of inner furnace refractories 2 with respect to the present embodiment in the same way as the embodiments shown in FIGS. 1 to 5.

In addition, since other constructions and materials of other members are the same as those in the embodiments shown in FIGS. 1 to 5, the same reference numerals are attached and a detail description will be omitted.

Furthermore, the configuration shown in FIG. 10, in which adjacent supporting members for connecting 3 above and below are upwardly inclined at an inclination angle of $\theta_1$ or $\theta_2$, can be employed in the embodiments shown in FIGS. 1 to 7 in which a supporting member for connecting 3 is inserted into a groove 8. The same operations and effects are obtained in these cases.

A metallic structural member 1 which is used to construct a structural member of a furnace in accordance with the present invention preferably has a configuration in which a cast metal portion 7 is cast around a cooling tube 6 while taking into consideration ease of manufacturing, integrity in the construction, and the like as the above-described embodiments. However, other configurations may be employed in such a manner that a body of a metallic structural member is manufactured by casting, rolling or the like, and a cooling tube is attached to the metallic structural member or a flow path for a coolant is formed by a boring process or the like.

Furthermore, an optional metal material (a casting material or a rolling material) such as Cu or Cu alloys other than cast steel can be employed as a material of the metallic structural member 1.

The above-described structural member of a furnace body in accordance with the present invention is used for constructing a wall and a bottom of a vertical metallurgical furnace such as a blast furnace, a scrap smelting furnace, or the like. For example, with respect to a furnace wall, the structural member of a furnace body is usually cumulated in the inside of the furnace body shell, and the furnace wall is constructed by fixing the metallic structural member 1 to the furnace body shell.

With respect to a structural member of a furnace body in accordance with the present invention, inner furnace refractories 2 are properly cooled by a cooling surface x of a metallic structural member 1 having a cooling tube 6. On the other hand, a supporting member for connecting 3 which supports the inner furnace refractories 2 is made of a metal such as stainless steel or the like, so that breakage hardly occurs. In addition, since a supporting member for connecting 3 is made of metal and a heat insulating member 4 is also inserted between the supporting member for connecting 3 and a groove for mounting 8 or a hole for mounting 8*a,* cooling of the inside of the inner furnace refractories is properly suppressed. Therefore, thermal inhomogeneities do not occur in the inside of the inner furnace refractories because of cooling by the supporting member for connecting 3, so that damage to the refractories does not occur. As a result, the inner furnace refractories 2 are effectively prevented from falling off.

With respect to a structural member for a furnace body in accordance with the present invention using stainless steel (SUS-310S) as shown in FIGS. 1 to 5 as a supporting member for connecting and with respect to a structural member for a furnace body in a comparative example using Mo—$ZrO_2$ as a supporting member for connecting (a structural member for a furnace body disclosed in Japanese Unexamined Patent Publication No. 7-90334), assuming that they are applied to a wall of a blast furnace, temperatures on front surfaces (inner surfaces of furnaces) and rear surfaces of the inner furnace refractories which are used to construct each structural member of a furnace body (a thickness of a brick was 400 mm) were measured. The results are shown below.

| | Example | Comparative Example |
|---|---|---|
| Supporting member for connecting | SUS-310S | Mo—$ZrO_2$ |
| Temperature on the front surface of refractories | 1000° C. | 700° C. |
| Temperature on the rear surface of refractories | 800° C. | 200° C. |

As shown in the above-described results, since the inner furnace refractories were cooled by not only the cooling surface but also the supporting member for connecting in the structural member of the furnace in the Comparative Example, a steep thermal gradient occurred in the thickness direction of the inner furnace refractories. On the other hand, a proper thermal gradient was obtained in the thickness direction of the inner furnace refractories in the structural member of the furnace in the Example in accordance with the present invention.

Next, one case of a method for manufacturing a structural member of a furnace in accordance with the present invention will be described according to FIGS. 11 and 12.

Figure 11A:
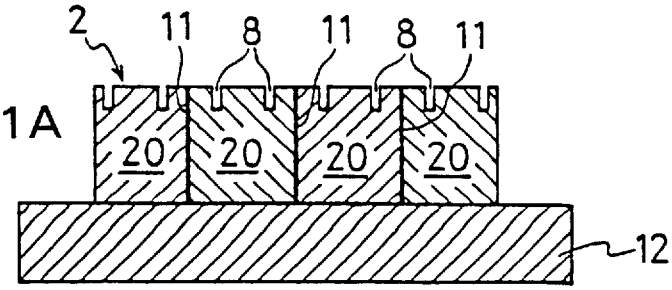
FIGS. 11A, 11B, 11C and 11D are schematic representations showing an example of a method for manufacturing structural members of a furnace body in accordance with the present invention, illustrated in the order of steps of processing.

First, as shown in FIG. 11A, each refractory brick 20 which will make up inner furnace refractories 2 is arranged on a flat base 12 in such a manner that a groove for mounting 8 faces upward. In this case a heat insulating member 11 is inserted between adjacent refractory bricks 20.

Figure 11B:
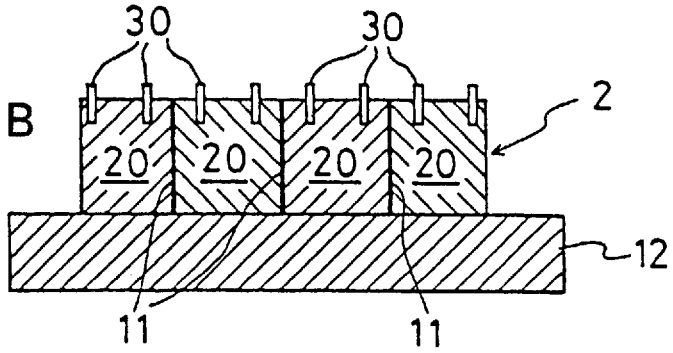

Next, as shown in FIG. 11B, a metallic cylindrical bar 30 which will be used to construct a supporting member for connecting 3 is inserted into each groove 8. In this case, a heat insulating material is wound around the outer side of the cylindrical bar 30 and the metallic cylindrical bar 30 is inserted into the groove 8, being attached with the heat insulating material, so that a heat insulating member 4 (not shown) is inserted between the supporting member for connecting 3 and the inner surface of the groove 8.

Figure 11C:
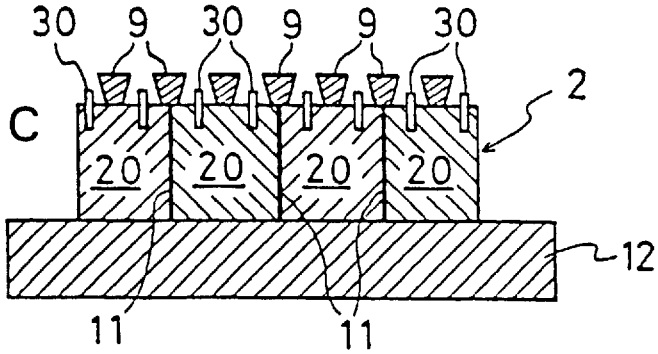

Furthermore, as shown in FIG. 11C, a rear brick 9 is attached between the adjacent cylindrical bars 30 on the upper surface (rear surface) of the refractory brick 20 using mortar 10.

Figure 11D:
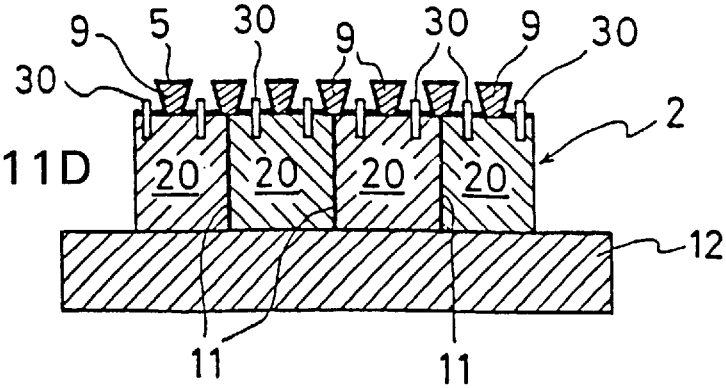
Figure 12A:
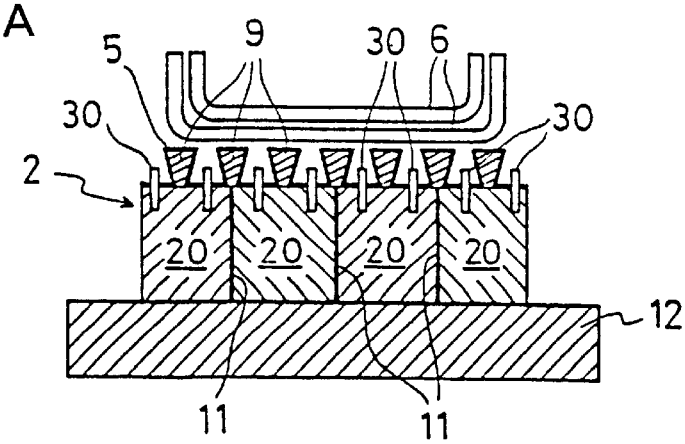
FIGS. 12A, 12B and 12C are schematic representations showing the example of the method for manufacturing structural members of a furnace body in accordance with the present invention illustrated in the order of steps of processing.
Figure 12B:
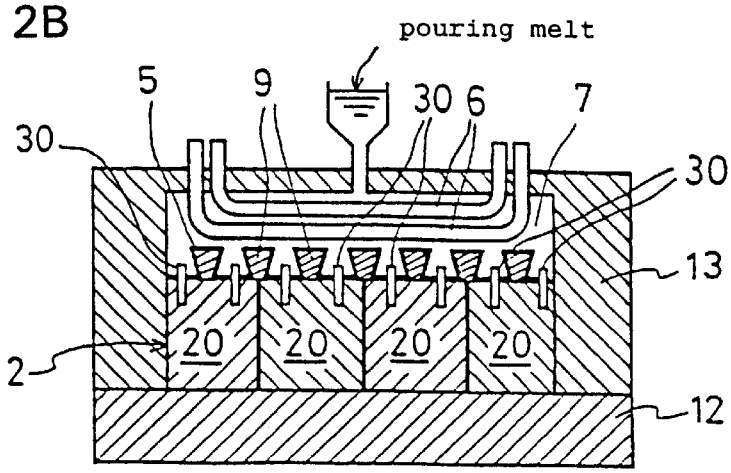
Figure 12C:
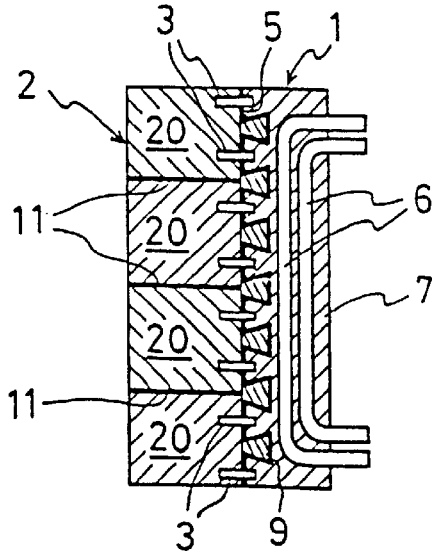

Next, as shown in FIG. 11D, a heat insulating buffer member 5 is fixed on the upper surface (rear surface) of the refractory brick 20 including the rear brick 9. Then, as shown in FIG. 12A, a cooling tube 6 which will be used to construct a part of a metallic structural member 1 is provided above the refractory brick 20 using a proper holding means. In this state, as shown in FIG. 12B, the inner furnace refractories 2 and the cooling tubes 6 which are provided above the inner furnace refractories 2 are covered with a mold 13. Then, a space inside the mold 13 including the cooling tubes 6 is cast. Thus, a metallic structural member 1 in which a cast metal portion 7 is cast around the cooling tubes 6 is formed. Furthermore, the end portion of each cylindrical bar 30 is integrated with the cast metal portion 7, and a supporting member for connecting 3 which is protrudingly provided on a cooling surface x of the metallic structural member 1 is formed. In addition, at this pouring, thermal shock to the refractory brick 20 due to pouring is absorbed by the heat insulating buffer member 5. After the casting is completed, the mold 13 is taken off, so that a structural member of a furnace body in which the metallic structural member 1 is connected with the inner furnace refractories 2 through the supporting member for connecting 3 is obtained.

As described above, with respect to a structural member of a furnace in accordance with the present invention inner furnace refractories are properly cooled and effectively prevented from deterioration. In addition, the inner furnace refractories are effectively prevented from falling off due to damage to the inner furnace refractories and breakage of a supporting member for connecting, so that the service life of a metallurgical shaft furnace such as a blast furnace can be prolonged to a large extent.

What is claimed is:

1. A structural member of a furnace body for a metallurgical shaft furnace, comprising:

a metallic structural member having a flow path for a coolant therein;

inner furnace refractories arranged on a cooling surface of said metallic structural member;

metallic supporting members protrudingly provided on said cooling surface of said metallic structural member for connectingly supporting said inner furnace refractories by being inserted into openings for mounting formed on a rear surface side of said inner furnace refractories, said metallic supporting members having enough tensile strength and enough bending strength for supporting said inner furnace refractories at a high temperature of 300 to 400° C.; and heat insulating members which are inserted between said metallic supporting members and inner surfaces of said openings.

2. The structural member of the furnace body according to claim 1, wherein said metallic structural member comprises a cooling tube which forms said flow path for the coolant and a cast metal portion which is cast around said cooling tube.

3. The structural member of the furnace body according to claim 1, further comprising a heat insulating buffer member inserted between said cooling surface of said metallic structural member and said rear surface of said inner furnace refractories.

4. The structural member of the furnace body according to claim 1, wherein:

said inner furnace refractories comprise a plurality of refractory bricks; and said openings for mounting comprise grooves which are formed at both side portions of a rear surface side of each refractory brick.

5. The structural member of the furnace body according to claim 4, wherein:

said grooves have a length "a" in a width direction of said refractory bricks;

a distance "L" is provided between said grooves for mounting and an upper end surface of said refractory bricks; and said length "a" and said distance "L" satisfy the equation of L>a.

6. The structural member of the furnace body according to claim 1, wherein said metallic supporting members comprise metallic cylindrical bars.

7. The structural member of the furnace body according to claim 1, further comprising a plurality of rear bricks provided protrudingly on said rear surface side of said inner furnace refractories, and wherein the cooling surface of the metallic structural member is formed along said rear surface side of said inner furnace refractories and includes an outer surface of said rear bricks.

8. The structural member of the furnace body according to claim 4, further comprising heat insulating members arranged between adjacent ones of said refractory bricks.

9. The structural member of the furnace body according to claim 1, wherein the metallic supporting members having a high heat resistance are SS-400.

10. The structural member of the furnace body according to claim 1, wherein the metallic supporting members having a high heat resistance are HA-230.

11. The structural member of the furnace body according to claim 1, wherein the metallic supporting member having a high strength are SUS-310S.

12. The structural member of the furnace body according to claim 1, wherein the heat insulating members are comprised of rock wool.

13. The structural member of the furnace body according to claim 1, wherein the heat inculcating members are comprised of glass wool.

* * * * *

UNITED STATES PATENT AND TRADEMARK OFFICE

CERTIFICATE OF CORRECTION

PATENT NO. : 6,258,315 B1
DATED : July 10, 2001
INVENTOR(S) : Tsuneo Araki et al.

It is certified that error appears in the above-identified patent and that said Letters Patent is hereby corrected as shown below:

Title page,
Item [45], Date of Patent, insert -- * -- before "Jul. 10, 2001",
Item [*], Notice, above "Subject to any. . " insert
-- This patent issued on a continued prosecution application filed under CFR 1.53 (d), and is subject to the twenty year patent term provisions of 35 U.S.C. 154 (a) (2). --.

Signed and Sealed this

Ninth Day of April, 2002

*Attest:*

*Attesting Officer*

JAMES E. ROGAN
*Director of the United States Patent and Trademark Office*